US008485997B2

(12) United States Patent
Chen

(10) Patent No.: US 8,485,997 B2
(45) Date of Patent: Jul. 16, 2013

(54) VIBRATING MASSAGER

(75) Inventor: Jung-Shang Chen, Taoyuan (TW)

(73) Assignee: Vicon Healthcare International Inc. (TW)

( * ) Notice: Subject to any disclaimer, the term of this patent is extended or adjusted under 35 U.S.C. 154(b) by 271 days.

(21) Appl. No.: 13/082,664

(22) Filed: Apr. 8, 2011

(65) Prior Publication Data

US 2012/0259254 A1 Oct. 11, 2012

(51) Int. Cl.
*A61H 1/00* (2006.01)

(52) U.S. Cl.
USPC ..... 601/46; 601/DIG. 16

(58) Field of Classification Search
USPC ..... 601/46, 48, 67, 70, 72, 78, 80, 81, 601/DIG. 16
See application file for complete search history.

(56) References Cited

U.S. PATENT DOCUMENTS

| | | | | |
|---|---|---|---|---|
| 2005/0288611 | A1* | 12/2005 | Fang | 601/70 |
| 2009/0012355 | A1* | 1/2009 | Lin | 600/41 |
| 2009/0306468 | A1* | 12/2009 | Tasker et al. | 600/41 |
| 2009/0312599 | A1* | 12/2009 | Smith | 600/38 |
| 2010/0010292 | A1* | 1/2010 | Talbot et al. | 600/38 |
| 2012/0116273 | A1* | 5/2012 | Nan | 601/46 |
| 2012/0136289 | A1* | 5/2012 | McGann | 601/78 |

* cited by examiner

*Primary Examiner* — Kristen Matter

(57) ABSTRACT

An improved vibrating massager is disclosed. The massager includes an inner shell, at least one vibrating unit, at least one power-supply unit, a control circuit board, at least two conductive strips having a first conductive strip and a second conductive strip, a switch, a first outer shell, a waterproof o-ring, and a second outer shell. Particularly the switch and the control circuit board are integrated and a program for memorizing previously-used vibrating frequency is installed in the control circuit board. As a result, the previously-used vibrating frequency can be re-applied in next use without extensive control (e.g., number of times for pushing button is decreased).

9 Claims, 7 Drawing Sheets

VIBRATING MASSAGER

BACKGROUND OF THE INVENTION

1. Technical Field

The present invention relates to an improved vibrating massager, and more particularly, the improved vibrating massager which has various vibrating modes and memory program.

2. Description of Related Art

With the evolution of the times, people become much busier in working or studying. After every daily work, people are too tired to do exercise, alternatively they do the static activity in their free time. Because of the lack of exercise, people get muscular aches easily. For soothing muscular aches, vibrating massager is generally used by people. However, there are many kinds of vibrating massager, and most of them have following three shortcomings in using and manufacturing:

1. For adjusting the vibrating mode easily, the switch of vibrating massager is usually rotary switch which causes the increasing of the cost of manufacturing, volume and weight. If alternating the rotary switch with a small-size button switch, it also makes user to press the button many times to adjust the vibrating mode, and it might cause decreasing of the using life of the button switch.
2. To avoid the short circuit, a plastic pad is configured on the wall of accommodating space to separate the conductive strip from the battery. However it's inconvenient that the plastic pad easily drops out, and user must reloads it before using.
3. It's inconvenient for user to replace the battery of the kind of small-size vibrating massager.

Accordingly, in view of the conventional vibrating massager having shortcomings and drawbacks, the inventor of the present application has made great efforts to make inventive research thereon and eventually provided an improved vibrating massager.

BRIEF SUMMARY OF THE INVENTION

The first objective of the present invention is to provide an improved vibrating massager comprising a button switch and a control circuit board which includes a memory program for memorizing the vibrating frequency previously used, wherein the vibrating frequency can be applied in next time, and in this way, the times of pushing button are decreased.

The second objective of the present invention is to provide an improved vibrating massager that separates the conductive strip from battery for avoiding the short circuit.

The third objective of the present invention is to provide an improved vibrating massager comprising a cover board which has an embedding structure, wherein the battery is embedded in the embedding structure, and the battery can be taken out when the cover board is opened.

Accordingly, to achieve the abovementioned first objective, second objective and third objective, the inventor processes an improved vibrating massager, the improved vibrating massager comprises: an inner shell (11) comprising a first inner shell portion (111) which has at least one first hole (1111) and a second inner shell portion (112) which has at least one second hole (1121), wherein the inner shell (11) further comprises an accommodating portion (113); at least one vibrating unit (12) being configured in the accommodating portion (113); at least one power-supply unit (13) being configured in the accommodating portion (113); a control circuit board (14) being configured at an opening of the accommodating portion (113) and connected with the power-supply unit (13); at least two conductive strips comprising: a first conductive strip (15) being configured at the outside of the first inner shell portion (111), and a second conductive strip (16) being configured at the outside of the second inner shell portion (112); a switch (17) being connected to the control circuit board (14); a first outer shell (18) being composed of a first outer shell portion (181) and a second outer shell portion (182), wherein the first outer shell portion (181) accommodates the inner shell (11) and the second outer shell portion (182) accommodates the control circuit board (14) and the switch (17); a waterproof o-ring (19) being configured between the first outer shell portion (181) and the second outer shell portion (182); and a colloidal ring (1D) being connected to the first outer shell (18), and being able to be put around an appropriate part of a human body.

BRIEF DESCRIPTION OF THE SEVERAL VIEWS OF THE DRAWINGS

The invention as well as a preferred mode of use and advantages thereof will be best understood by referring to the following detailed description of an illustrative embodiment in conjunction with the accompanying drawings, wherein.

DETAILED DESCRIPTION OF THE INVENTION

To more clearly describe an improved vibrating massager (1) according to the present invention, embodiments of the present invention will be described in detail with reference to the attached drawings hereinafter.

Figure 1:
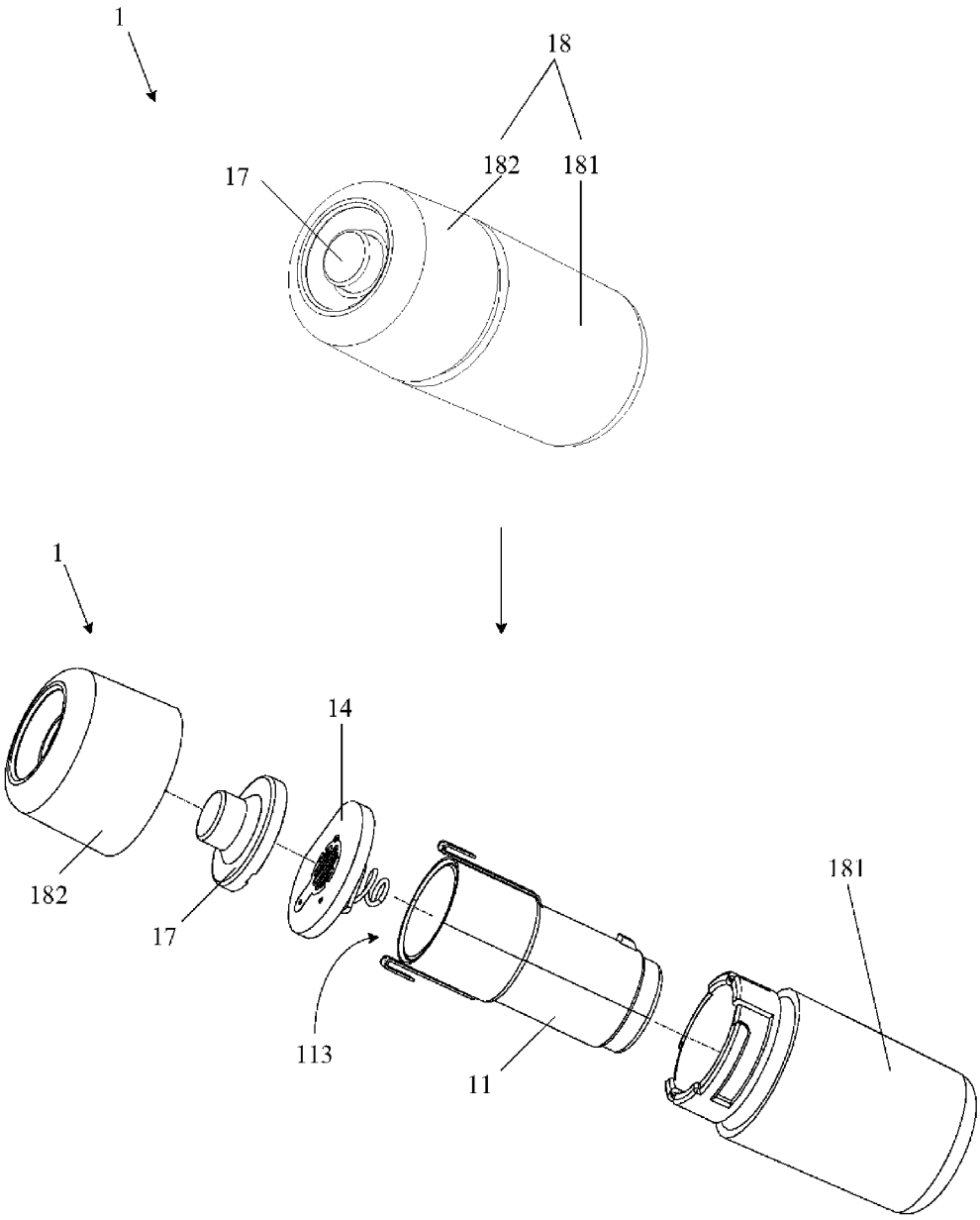
FIG. 1 is a partial combination diagram of a first practical embodiment of the improved vibrating massager according to the present invention.

With reference to FIG. 1 which illustrates a partial combination diagram according to a first preferred embodiment of the present invention. As shown in FIG. 1, the improved vibrating massager (1) includes: a first outer shell (18) being composed of a first outer shell portion (181) and a second outer shell portion (182), and a waterproof o-ring (19) being configured between the first outer shell portion (181) and the second outer shell portion (182), wherein the first outer shell portion (181) accommodates an inner shell (11) and the second outer shell portion (182) accommodates a control circuit board (14) and a switch (17), and the control circuit board (14) is configured at an opening of the second outer shell portion (182) and connected to the switch (17), wherein the switch (17) is a button switch made of conductive graphite, further-more, the switch (17) is also selected from the group consisting of: rotary switch and push rod switch.

Figure 2:
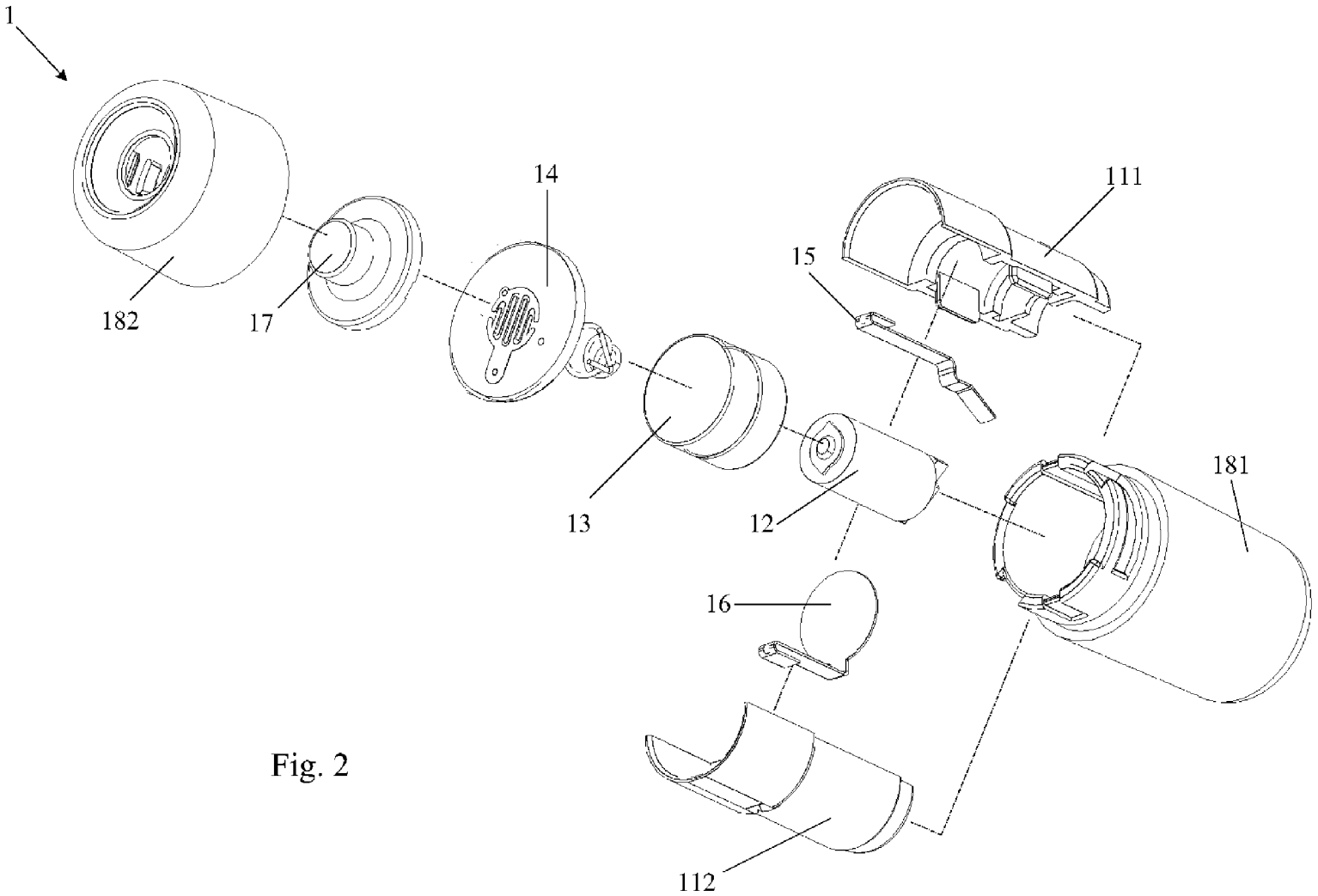
FIG. 2 is a exploded diagram of the first practical embodiment of the improved vibrating massager according to the present invention.
Figure 3:
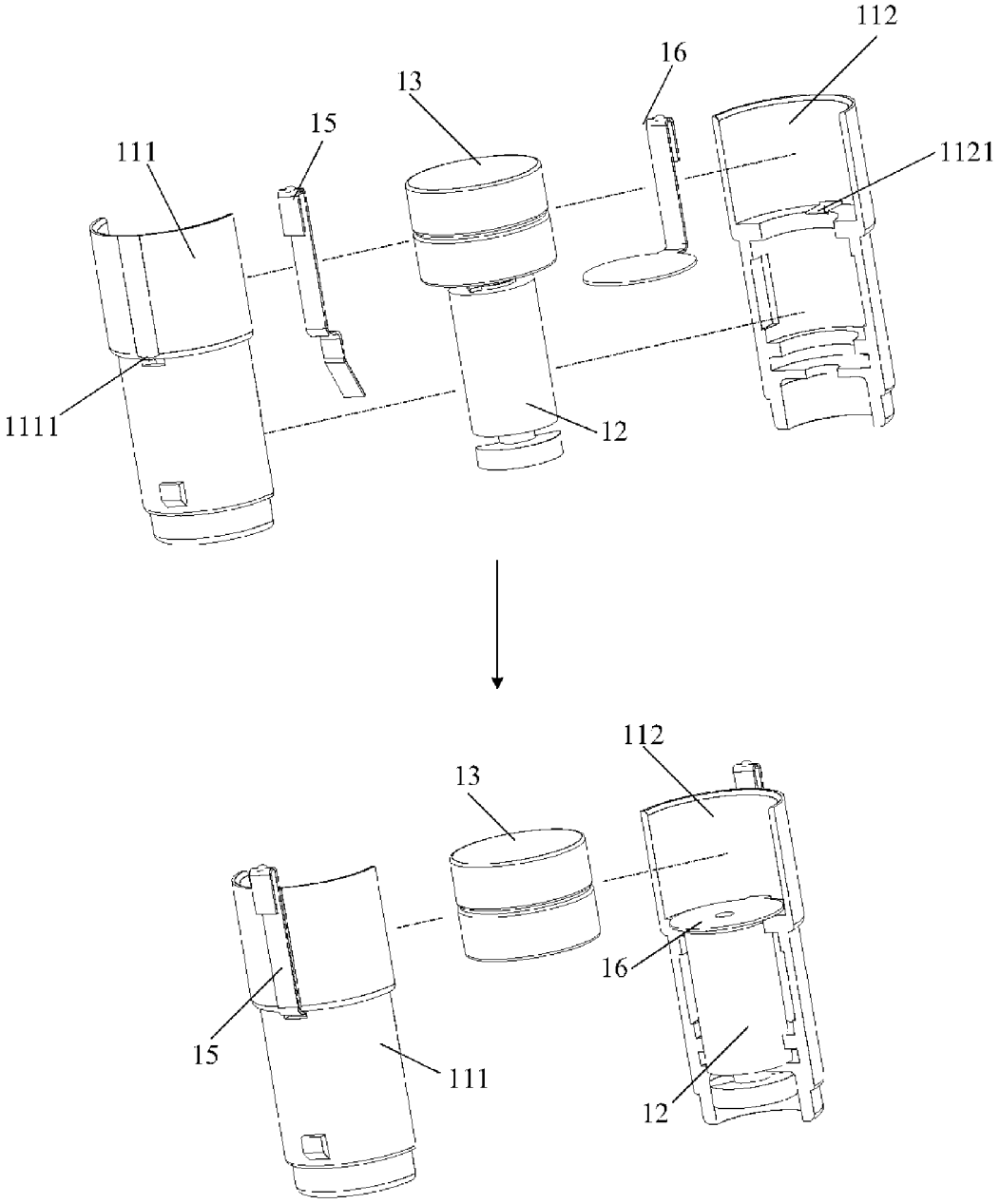
FIG. 3 is a partial combination diagram of the inner shell of the first practical embodiment of the improved vibrating massager according to the present invention.

Please refer to FIG. 2 and FIG. 3 which illustrate an exploded diagram and a partial combination diagram of the inner shell according to the first preferred embodiment of the present invention. As shown in FIG. 2 and FIG. 3, the inner shell (11) comprises a first inner shell portion (111) which has one first hole (1111) and a second inner shell portion (112) which has one second hole (1121). The inner shell (11) further comprises an accommodating portion (113) for accommodating a vibrating unit (12) and two power-supply units (13) for supplying electricity to the vibrating unit (12), wherein the power-supply units (13) are selected from the group consisting of: 2A battery, 3A battery and mercury battery. A first conductive strip (15) is configured at the outside of the first inner shell portion (111), wherein one end of the first conductive strip (15) is inserted in the first hole (1111) and connected to the vibrating unit (12), and an opposite end of the first conductive strip (15) is connected to the control circuit board (14). A second conductive strip (16) is configured at the outside of the second inner shell portion (112), wherein one end of the second conductive strip (16) is inserted in the second hole (1121) and connected between the vibrating unit (12) and the power-supply units (13), and an opposite end of the second conductive strip (16) is connected to the control circuit board (14). In order to avoid short circuit, the first conductive strip (15) and the second conductive strip (16) are separated from the power-supply units (13). According to the description above, it clearly discloses that the switch (17), the control circuit board (14), the power-supply units (13), the vibrating unit (12), the first conductive strip (15), and the second conductive strip (16) form an electrical circuit.

The control circuit board (14) further comprises a control chip (141) for adjusting the vibration modes of the vibrating unit (12) by pushing the switch (17), and a memory program for memorizing the vibrating frequency previously used, wherein the vibrating frequency can be applied in next time. The manner to operate the memory program is to press the switch (17) continually until the massager is turned off, and when turning on the massager next time, the vibrating frequency used previously can be applied. Otherwise, if the user doesn't want to use the memory program, the user just can push the switch (17) repeatedly until the massager is turned off.

Figure 4:
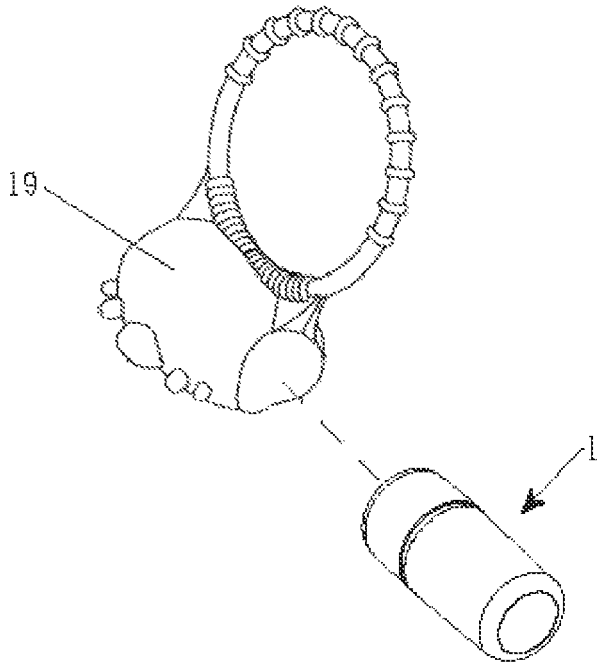
FIG. 4 is a stereo diagram of the first practical embodiment of the improved vibrating massager according to the present invention.
Figure 5:
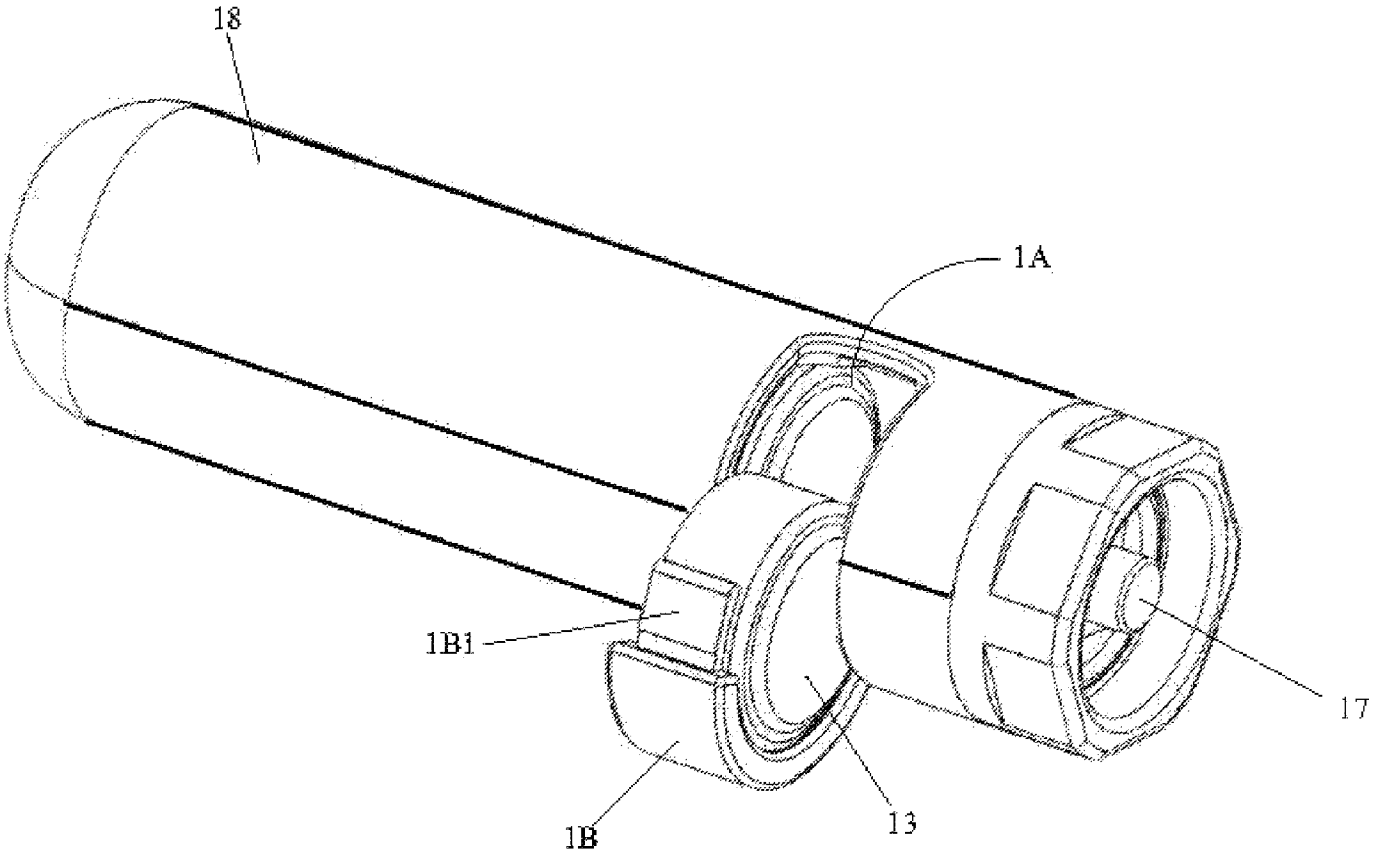
FIG. 5 is a stereo diagram of opened cover board of the first practical embodiment of the improved vibrating massager according to the present invention.

Please refer to FIG. 4 which illustrates a stereo diagram of the first preferred embodiment according to the present invention. As shown in FIG. 4, a colloidal ring (1D) is connected to the first outer shell (18), and can be put around an appropriate part of a human body, wherein the colloidal ring (1D) can be exchanges with a new one and is made of the material selected from the group consisting of: rubber, latex and silica gel;

Please refer to FIG. 5 which illustrates a stereo diagram of an opened cover board of the first preferred embodiment of the improved vibrating massager. As shown in FIG. 5, the improved vibrating massager (1) further comprises a third hole (1A) configured on the corresponding positions of the first outer shell (18) and the inner shell (11) for accommodating the power-supply units (13), and a cover board (1B) comprising an embedding structure (1B1) for covering the third hole (1A), wherein one of the power-supply units (13) is embedded in the embedding structure (1B1), and the power-supply units (13) can be taken out when the cover board (1B) is opened.

Figure 6:
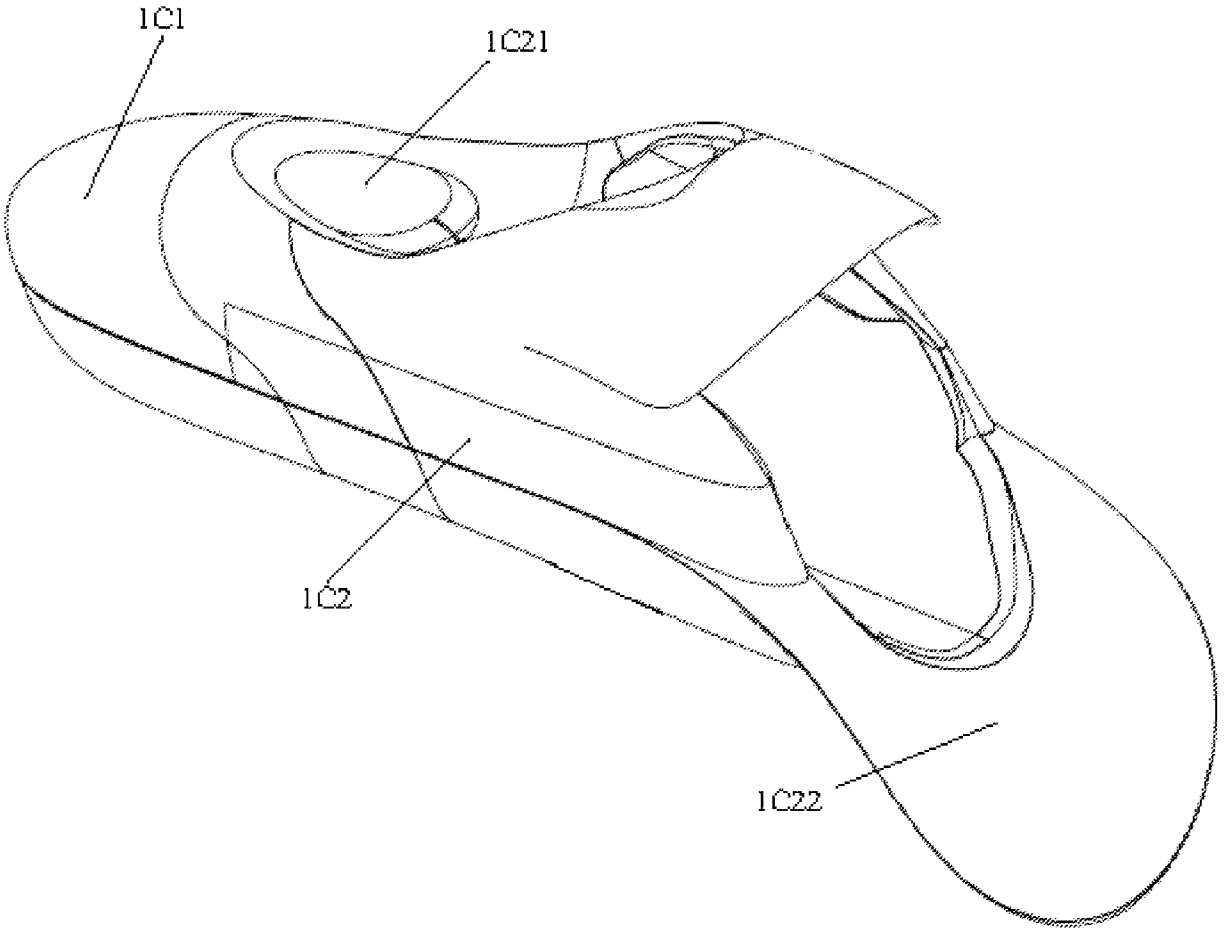
FIG. 6 is a combination diagram of a second practical embodiment of the improved vibrating massager according to the present invention.
Figure 7:
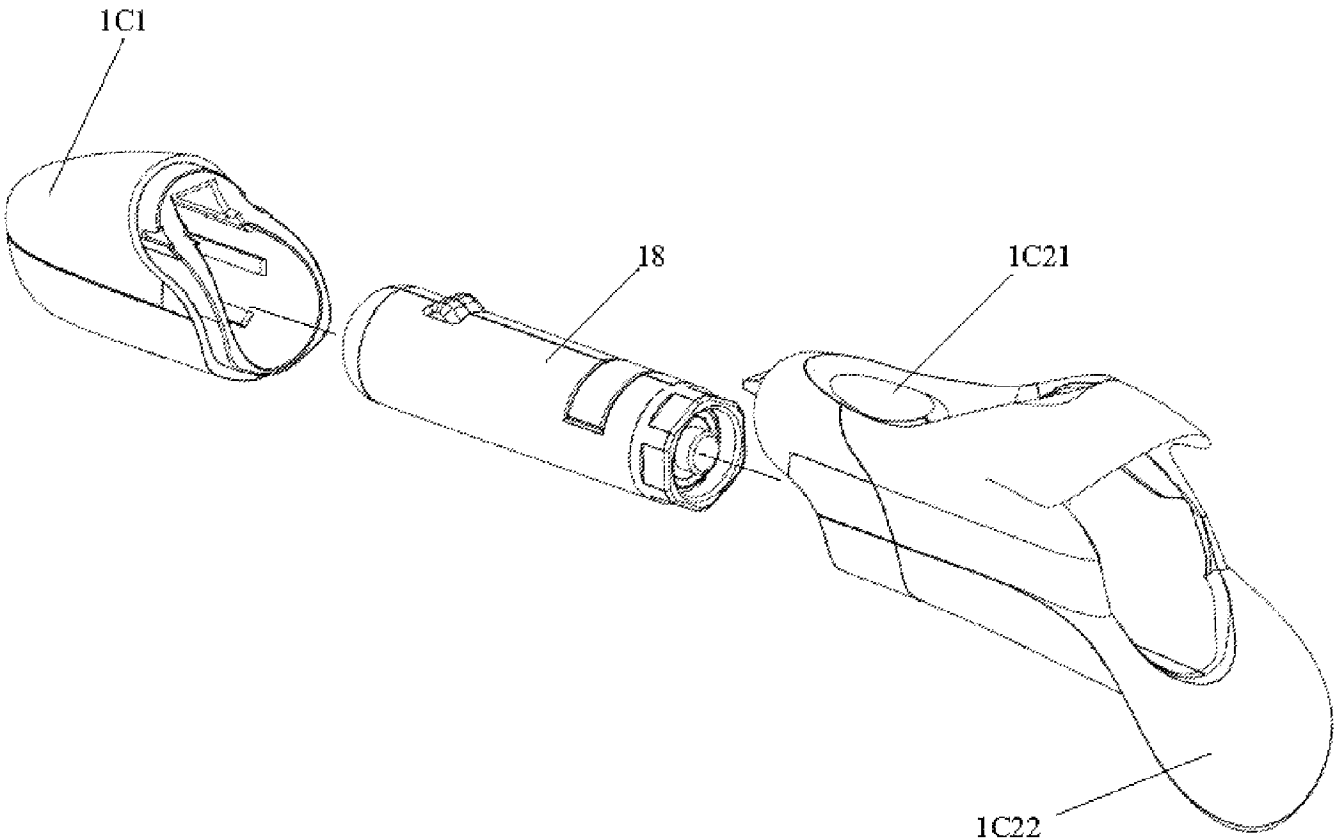
FIG. 7 is an exploded diagram of a second practical embodiment of the improved vibrating massager according to the present invention.

In the end, please refer to FIG. 6 and FIG. 7 which illustrate a combination diagram and an exploded diagram of a second preferred embodiment of the improved vibrating massager according to the present invention. As shown in FIG. 6 and FIG. 7, the difference between the first and the second embodiment is that the colloidal ring (1D) is replaced with a second outer shell (1C) composed of a third outer shell portion (1C1) and a forth outer shell portion (1C2), wherein the third outer shell portion (1C1) accommodates one end of the first outer shell (18) and the forth outer shell portion (1C2) accommodates the opposite end of the first outer shell (18), and wherein the connection manner of the third outer shell portion (1C1) and the forth outer shell portion (1C2) is selected from the group consisting of: buckling and screwing. Wherein the forth outer shell portion (1C2) comprises a fixing portion (1C21) which can be put around a finger and a support portion (1C22) holding on the root of the finger for being the fulcrum of the finger. Moreover, for providing a comfortable touch feeling to users, the forth outer shell portion (1C2) can be made of the kinds of soft material selected from the group consisting of: rubber, latex and silica gel.

Thus, through the first embodiment and the second embodiment, the improved vibrating massager (1) of the present invention has been completely and clearly disclosed in the above description, and in summary, the present invention has the following advantages:

1. The control circuit board comprises the control chip being written in various programs for supplying various vibrating modes and further comprises the memory program for memorizing the vibrating frequency previously used, wherein the vibrating frequency can be applied in next time, the application of the memory program decreases the times of pressing the switch, so the using life of the switch will be increased.
2. Configuring the conductive strip at the outside of the inner shell, in this way, the short circuit can be avoided.
3. The power-supply unit is embedded in the embedding structure of the cover board and can be taken out when the cover board (1B) is opened, and it's convenient for users to take out the small-size battery.

The above description is made on embodiments of the present invention. However, the embodiments are not intended to limit scope of the present invention, and all equivalent implementations or alterations within the spirit of the present invention still fall within the scope of the present invention.

I claim:

1. An improved vibrating massager, comprising:

an inner shell comprising a first inner shell portion which has a first hole and a second inner shell portion which has a second hole, wherein the inner shell further comprises an accommodating portion;

a vibrating unit being configured in the accommodating portion;

a power-supply unit being configured in the accommodating portion for supplying electricity to the vibrating unit;

a control circuit board being configured at an opening of the accommodating portion and connected with the power-supply unit, wherein the control circuit board is used to control the vibrating unit to vibrate with a vibration frequency;

at least two conductive strips comprising:

a first conductive strip being configured at an outside of the first inner shell portion, wherein one end of the first conductive strip is inserted in the first hole and connected to the vibrating unit, and an opposite end of the first conductive strip being connected to the control circuit board; and a second conductive strip being configured at an outside of the second inner shell portion, wherein one end of the second conductive strip is inserted in the second hole and connected between the vibrating unit and the power-supply unit, and an opposite end of the second conductive strip being connected to the control circuit board;

a switch being connected to the control circuit board, and forming an electrical circuit with the vibrating unit, the power-supply unit, the first conductive strip, and the second conductive strip, wherein a control signal can be sent to the control circuit board for adjusting the vibration frequency of the vibrating unit by pushing the switch;

a first outer shell being composed of a first outer shell portion and a second outer shell portion, wherein the first outer shell portion accommodates the inner shell and the second outer shell portion accommodates the control circuit board and the switch;

a waterproof o-ring being configured between the first outer shell portion and the second outer shell portion; and a second outer shell being composed of a third outer shell portion and a fourth outer shell portion, wherein the third outer shell portion accommodates one end of the first outer shell and the fourth outer shell portion accommodates the opposite end of the first outer shell.

2. The improved vibrating massager of claim 1, wherein the power-supply unit is selected from the group consisting of: 2A battery, 3A battery and mercury battery.

3. The improved vibrating massager of claim 1, wherein the control circuit board comprises a control chip for controlling the vibration frequency of the vibrating unit, and a memory program for memorizing a previously -used vibrating frequency, wherein the previously -used vibrating frequency can be reapplied in a next use of the massager.

4. The improved vibrating massager of claim 1, wherein the switch is selected from the group consisting of: rotary switch, button switch and push rod switch.

5. The improved vibrating massager of claim 1, wherein the switch is made of conductive graphite.

6. The improved vibrating massager of claim 1, wherein the fourth outer shell portion comprises a fixing portion which can be put around a finger.

7. The improved vibrating massager of claim 1, wherein the fourth outer shell portion comprises a support portion adapted to hold on a root of a finger for being a fulcrum of the finger.

8. The improved vibrating massager of claim 1, wherein the fourth outer shell portion can be made of the material selected from the group consisting of: rubber, latex and silica gel.

9. The improved vibrating massager of claim 1, wherein the connection manner of the third outer shell portion and the fourth outer shell portion is selected from the group consisting of: buckling and screwing.

* * * * *